United States Patent [19]

Mitsuyasu

[11] Patent Number: 5,070,848

[45] Date of Patent: Dec. 10, 1991

[54] DEVICE FOR CONTROLLING A FUEL FEED PUMP USED FOR AN ENGINE

[75] Inventor: Masaki Mitsuyasu, Susono, Japan

[73] Assignee: Toyota Jidosha Kabushiki Kaisha, Toyota, Japan

[21] Appl. No.: 498,815

[22] Filed: Mar. 23, 1990

[30] Foreign Application Priority Data

Mar. 27, 1989 [JP] Japan ..... 1-71965

[51] Int. Cl.[5] ..... F02M 37/04

[52] U.S. Cl. ..... 123/506; 123/456

[58] Field of Search ..... 123/497, 498, 499, 506, 123/456, 299, 300

[56] References Cited

U.S. PATENT DOCUMENTS

| | | | |
|---|---|---|---|
| 4,700,672 | 10/1987 | Baguena | 123/299 |
| 4,704,999 | 11/1987 | Hashikawa | 123/299 |
| 4,730,585 | 3/1988 | Abe | 123/300 |
| 4,753,212 | 6/1988 | Miyaki | 123/506 |
| 4,782,807 | 11/1988 | Takahashi et al. | 123/506 |
| 4,793,314 | 12/1988 | Yoshinaga | 123/506 |
| 4,838,233 | 6/1989 | Hayashi | 123/300 |

FOREIGN PATENT DOCUMENTS

| | | | |
|---|---|---|---|
| 0074550 | 3/1983 | European Pat. Off. . | |
| 62-258160 | 11/1987 | Japan . | |
| 63-138438 | 9/1988 | Japan . | |
| 64-87848 | 3/1989 | Japan . | |
| 1294958 | 11/1989 | Japan | 123/498 |

*Primary Examiner*—Carl Stuart Miller
*Assistant Examiner*—Erick Solis
*Attorney, Agent, or Firm*—Kenyon & Kenyon

[57] ABSTRACT

A device for controlling a fuel feed pump comprising a fuel spill passage and a spill control valve arranged in the fuel spill passage. The spill control valve is controlled by the pressure of fuel in a pressure chamber, and the pressure of the pressure chamber is controlled by the piezoelectric element. When the piezoelectric element is driven, the pressure of the pressure chamber is increased, and thus the spill control valve is closed. When the engine speed is high, the piezoelectric element is driven at each 360 degrees of rotation of the crankshaft. Conversely, when the engine speed is low, the piezoelectric element is driven at each 120 degrees rotation of the crankshaft.

16 Claims, 10 Drawing Sheets

DEVICE FOR CONTROLLING A FUEL FEED PUMP USED FOR AN ENGINE

BACKGROUND OF THE INVENTION

1. Field of the Invention

The present invention relates to a device for controlling a fuel feed pump used for an engine.

2. Description of the Related Art

In a known fuel feed pump control device for an engine, a fuel spill passage is branched from the high pressure fuel passage connected to the discharge port of the fuel feed pump driven by the engine, and a spill control valve is arranged in the fuel spill passage. The fuel feed pump control device is provided with a pressure chamber, and the pressure therein is controlled by the piezoelectric element. The spill control valve is controlled by changing the pressure of the working liquid contained in the pressure chamber (see Japanese Unexamined Utility Model publication No. 63-138438).

In this fuel feed pump control device when the piezoelectric element is expanded, and accordingly the pressure of the working liquid in the pressure chamber increased, the spill control valve is moved by the pressurized working liquid and closed. Conversely, if the piezoelectric element is contracted, and accordingly the pressure of the working liquid in the pressure chamber is lowered, the spill control valve is opened and a part of the pressurized fuel in the high pressure fuel passage is spilled out. Consequently, in this fuel feed pump control device, by controlling the spill control valve with the piezoelectric element, the amount of pressurized fuel discharged from the high pressure fuel passage connected to the discharge port of the fuel feed pump is controlled, and the amount of this pressurized fuel discharged as mentioned above is increased as the closing time of the spill control valve becomes longer than the opening time thereof.

In this fuel feed pump control device, when the piezoelectric element is expanded, and accordingly the pressure of the working liquid in the pressure chamber is increased as mentioned above, a part of the pressurized working liquid leaks from the pressure chamber. Nevertheless, even if a part of the pressurized working liquid leaks as mentioned above, when the piezoelectric element is contracted, and accordingly, the pressure of the working liquid in the pressure chamber is lowered, fresh working liquid is fed into the pressure chamber via the check valve to make up the loss of the working liquid. Consequently, when the piezoelectric element is again expanded, the pressure of the working liquid in the pressure chamber usually can be increased to a predetermined pressure.

In such a fuel feed pump control device for controlling the fuel feed pump driven by the engine, however, the piezoelectric element is expanded at a predetermined crankangle of the engine, and the piezoelectric element is contracted before it is again expanded. Consequently, when the engine is operating at a low speed, if a degree of the crankangle during which the piezoelectric element remains expanded becomes larger than a degree of angle of the crankshaft rotation during which the piezoelectric element remains contracted, the time during which the piezoelectric element remains expanded becomes very long, and as a result, since the pressure of the working liquid in the pressure chamber during this time becomes much lower due to the leakage of the working liquid, a problem occurs in that it is impossible to maintain the spill control valve at the closed position.

SUMMARY OF THE INVENTION

An object of the present invention is to provide a fuel feed pump control device capable of maintaining the spill control valve at the closed position for a required time, regardless of the engine speed.

Therefore, according to the present invention, there is provided a device for controlling a fuel feed pump which discharges fuel under pressure into a pressurized fuel passage to feed the fuel into an engine via a fuel injector that initiates and terminates the discharge of fuel into the engine independently of the pressure of the fuel in the pressurized fuel passage, the fuel feed pump being driven by the engine and discharging the fuel under pressure at a rate which changes over a first fixed angle of the crankshaft of the engine, the device comprising: an piezoelectric element; a fuel spill passage branched from the pressurized fuel passage; a pressure chamber filled with a working liquid having a pressure which is controlled by the piezoelectric element; a normally opened spill control valve arranged in the fuel spill passage and controlled by the pressure of the working liquid in the pressure chamber; detecting means for detecting an engine speed; means for expanding the piezoelectric element each time the crankshaft of the engine rotates through a predetermined angle of rotation, to increase the pressure in the pressure chamber and maintain the pressure in the pressure chamber at an increased pressure to close the spill control valve; and control means for controlling the predetermined angle of rotation in accordance with a change in the engine speed, to make the predetermined angle of rotation smaller as the engine speed becomes lower.

The present invention may be more fully understood from the description of a preferred embodiment of the invention set forth below, together with the accompanying drawings.

DESCRIPTION OF A PREFERRED EMBODIMENT

Figure 4:
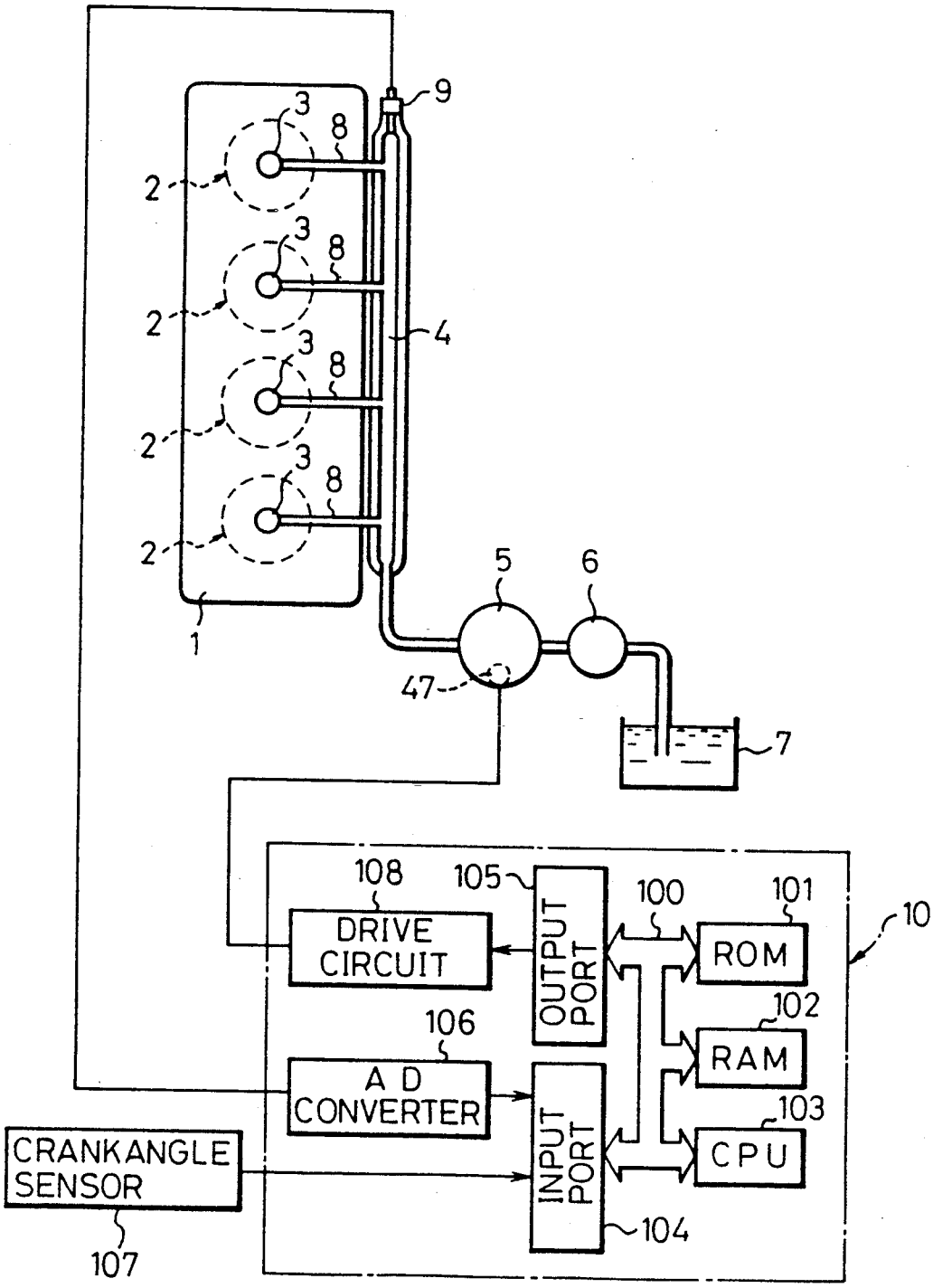
FIG. 4 is a general view of an engine.

FIG. 4 is a general view of the engine.

Referring to FIG. 4, reference numeral 1 designates an engine body, 2 cylinders, 3 fuel injectors provided for each cylinder 2, and 4 a reservoir chamber. The reservoir chamber 4 is connected to a fuel tank 7 via a pressurized fuel feed control device 5 and a fuel pump 6. The low pressure fuel pump 6 is provided for feeding fuel into the pressurized fuel feed control device 5. This low pressure fuel is raised to a high pressure by the pressurized fuel feed control device 5, and then this pressure fuel is fed into the reservoir tank 4. The high pressure fuel, accumulated in the reservoir chamber 4 is injected into the cylinders 2 via fuel distribution pipes 8 and the fuel injectors 3. A pressure sensor 9 is arranged in the reservoir chamber 4 to detect the pressure of fuel in the reservoir chamber 4.

Figure 1:
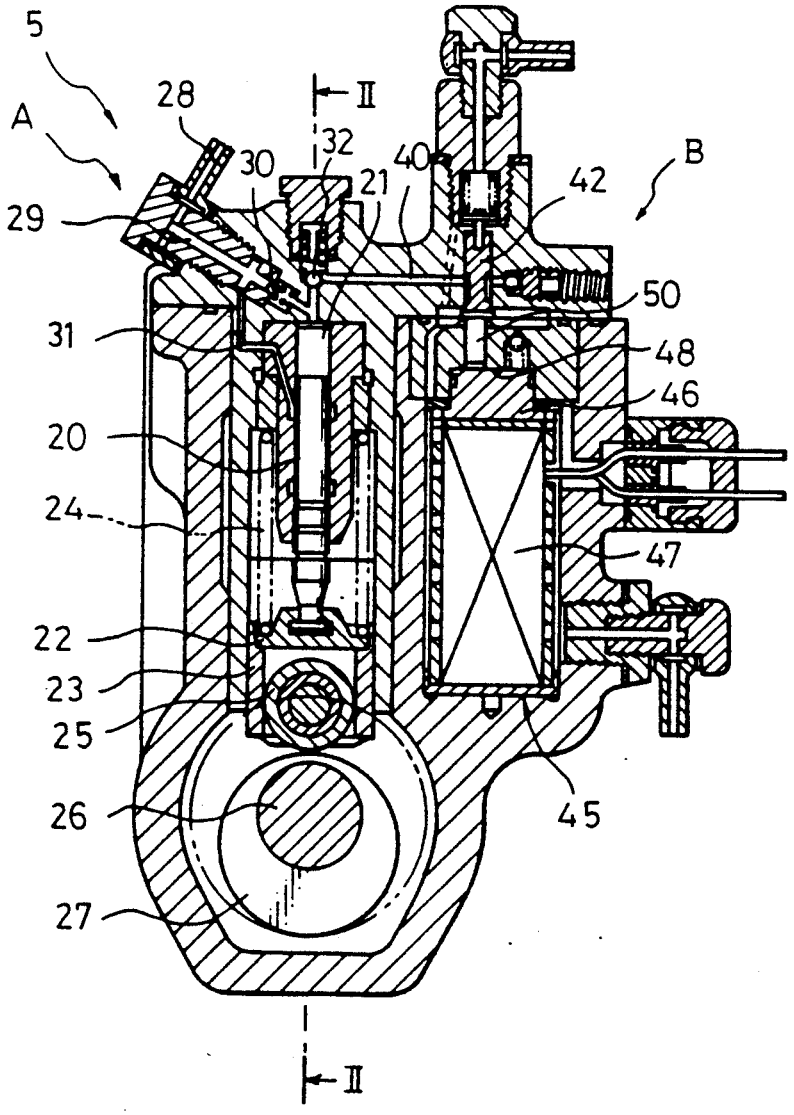
FIG. 1 is a cross-sectional side view of a pressurized fuel feed control device.
Figure 2:
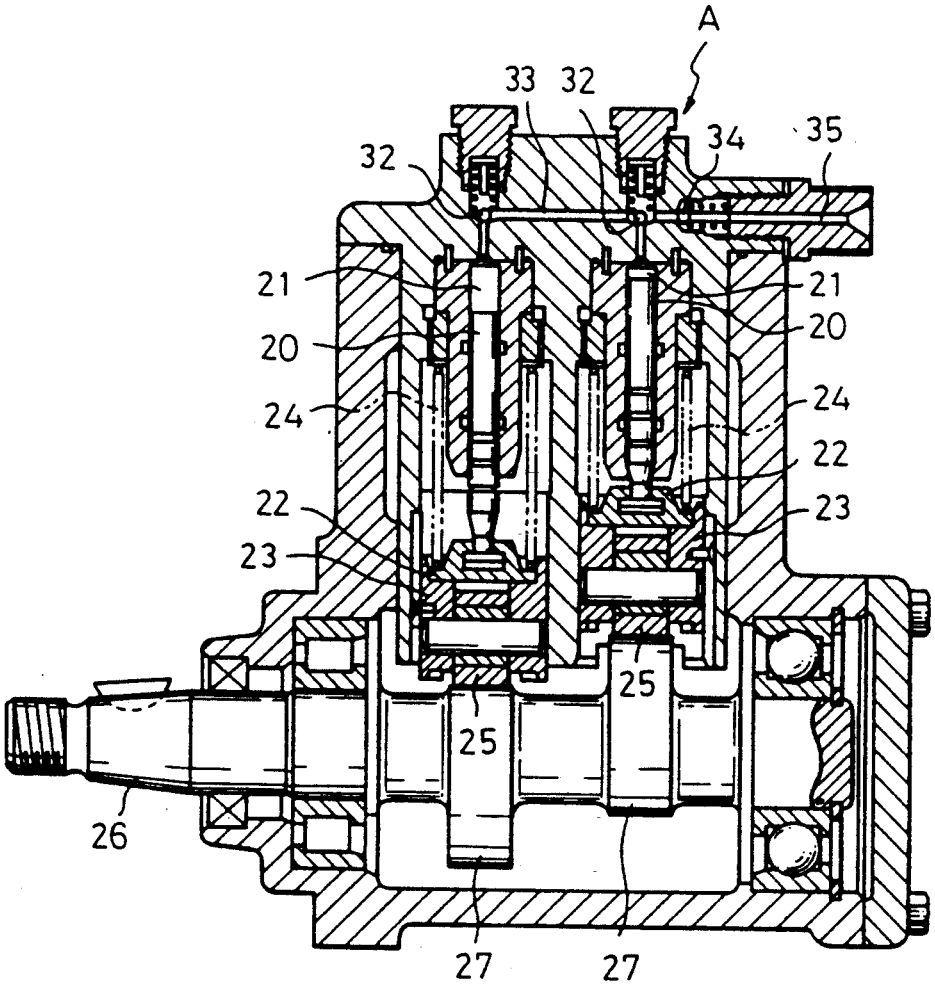
FIG. 2 is a cross-sectional view of the fuel feed pump, taken along the line II—II in FIG. 1.
Figure 3:
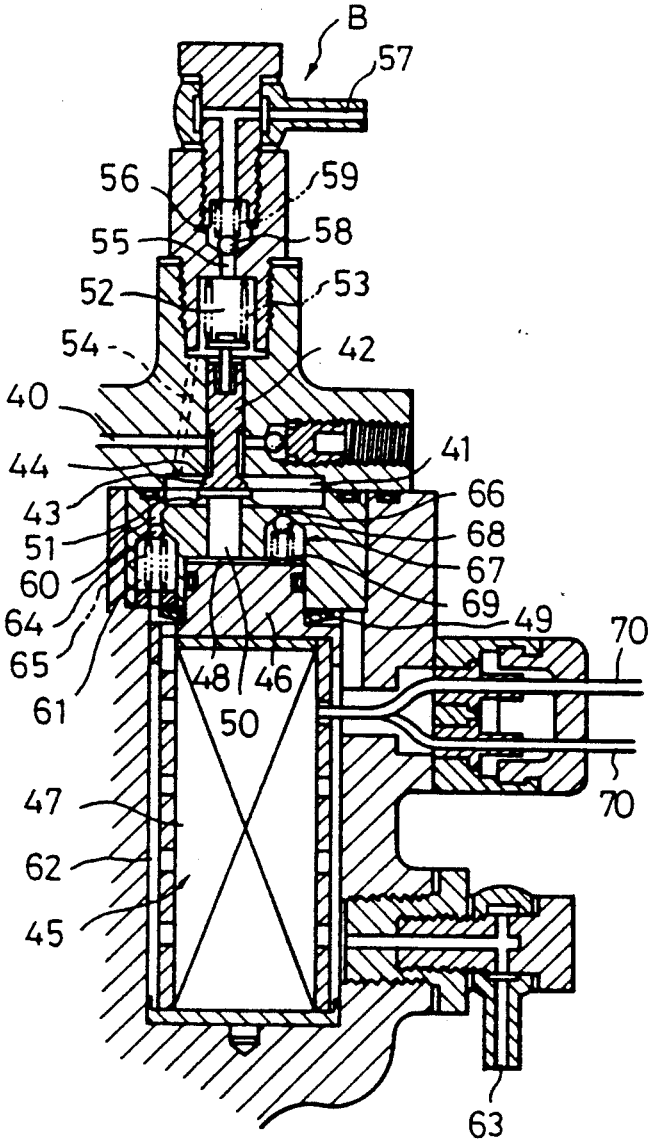
FIG. 3 is an enlarged cross-sectional side view of the discharge amount control device illustrated in FIG. 1.

FIG. 1 is a cross-sectional side view of the entire pressurized fuel feed control device 5. If this device 5 is roughly divided into two parts, it comprises a fuel feed pump A and a discharge amount control device B for controlling the amount of fuel discharged from the fuel feed pump A. FIG. 2 is a cross-sectional view of the fuel feed pump A, and FIG. 3 is an enlarged cross-sectional side view of the discharge amount control device B. First, the construction of the fuel feed pump A will be described with reference to FIGS. 1 and 2, and thereafter, the construction of the discharge amount control device B will be described with reference to FIG. 3.

Referring to FIGS. 1 and 2, reference numeral 20 designates a pair of plungers, 21 pressure chambers defined by the corresponding plungers 20, 22 plates mounted on the lower ends of the plungers 20, and 23 tappets; 24 designates compression springs for biasing the plates 23 toward the corresponding tappets 22, 25 rolls rotatably supported by the tappets 23, 26 a camshaft driven by the engine, and 27 a pair of cams integrally formed on the camshaft 26. The rollers 25 rotate on the cam surface of the corresponding cams 27, and when the camshaft 26 is rotated, the plungers 20 move up and down.

Referring to FIG. 1, a fuel inlet 28 is formed on the top portion of the fuel feed pump A and connected to the discharge port of the fuel pump 6 (FIG. 4). This fuel inlet 28 is connected to the pressure chambers 21 via a fuel feed passage 29 and a check valve 30 so that, when the plungers 20 move downward, fuel is fed into the pressure chambers 21 from the fuel feed passage 29. In FIG. 1, reference numeral 31 designates a fuel return passage for returning fuel, which has leaked from the clearances around the plungers 20, to the fuel feed passage 29.

As illustrated in FIGS. 1 and 2, the pressure chambers 21 are connected, via corresponding check valves 32, to a pressurized fuel passage 33 which is common to both the pressure chambers 21. This pressurized fuel passage 33 is connected to a pressurized fuel discharge port 35 via a check valve 34, and this pressurized fuel discharge port 35 is connected to the reservoir chamber 4 (FIG. 4). Consequently, when the plungers 20 move upward, and thus the pressure of fuel in the pressure chambers 21 is increased, the high pressure fuel in the pressure chambers 21 is discharged into the pressurized fuel passage 33 via the check valves 34 and then fed into the reservoir chamber 4 (FIG. 4) via the check valve 34 and the fuel discharge port 35. The cam phase of one of the cams 27 is deviated from the cam phase of the other cam 27 by 180 degrees, and therefore, when one of the plungers 20 is moving upward to discharge high pressure fuel, the other plunger 20 is moving downward to suck in fuel. Consequently, high pressure fuel is fed into the pressurized fuel passage 33 from either one of the pressure chambers 21. Namely, high pressure fuel is continuously fed into the pressurized fuel passage 33 by the plungers 20. As illustrated in FIG. 1, a fuel spill passage 40 is branched from the pressurized fuel passage 33 and connected to the discharge amount control device 40.

Referring to FIG. 3, the discharge amount control device B comprises a fuel spill chamber 41 formed in the housing thereof, and a spill control valve 42 for controlling the fuel flow from the fuel spill passage 40 toward the fuel spill chamber 41. The spill control valve 42 has a valve head 43 positioned in the fuel spill chamber 41, and the opening and closing of a valve port 44 is controlled by the valve head 43. In addition, an actuator 45 for actuating the spill control valve 42 is arranged in the housing of the discharge amount control device B. This actuator 45 comprises a pressure piston 46 slidably inserted into the housing of the discharge amount control device B, a piezoelectric element 47 for driving the pressure piston 46, a pressure chamber 48 defined by the pressure piston 46, a flat spring 49 for biasing the pressure piston 46 toward the piezoelectric element 45, and a pressure pin 50 slidably inserted into the housing of the discharge amount control device B. The upper end face of the pressure pin 50 abuts against the valve head 43 of the spill control valve 42, and the lower end face of the pressure pin 50 is exposed to the pressure chamber 48. A flat spring 51 is arranged in the fuel spill chamber 41 to continuously bias the pressure pin 50 upward, and a spring chamber 52 is formed above the spill control valve 42 and a compression spring 53 is arranged in the spring chamber 52. The spill control valve 42 is continuously urged downward by the compression spring 53. The fuel spill chamber 41 is connected to the spring chamber 52 via a fuel outflow bore 54, and the spring chamber 52 is connected to the fuel tank 7 (FIG. 4) via a fuel outflow bore 55, a check valve 56, and a fuel outlet 57. The check valve 56 comprises a check ball 58 normally closing the fuel outflow bore 55, and a compression spring 59 for urging the check ball 58 toward the fuel outflow bore 55. In addition, the fuel spill chamber 41 is connected to the fuel tank 7 (FIG. 4) via a fuel outflow bore 60, a check valve 61, a fuel outflow passage 62 formed around the piezoelectric element 47, and a fuel outlet 63. The check valve 61 comprises a check ball 64 normally closing the fuel outflow bore 60, and a compression spring 65 for biasing the check ball 64 toward the fuel outflow bore 60. Furthermore, the fuel spill chamber 41 is connected to the pressure chamber 48 via a flow area restricted passage 66 and a check valve 67. The check valve 67 comprises a check ball 68 normally closing the flow area restricted passage 66, and a compression spring 69 for biasing the check ball 66 toward the flow area restricted passage 66. The flow area restricted passage 66 has a cross-sectional area which is smaller than that of the fuel outflow bore 60. In addition, the valve opening pressures of a pair of the check valves 56 and 61 are made the same, and the valve opening pressure of the check valve 67 is made lower than the valve opening pressures of the check valves 56 and 61. That is, the compression springs 59 and 65 of the check valves 56 and 61 have almost the same spring force, and the spring force of the compression spring 69 of the check valve 67 is made weaker that of the compression springs 59 and 65.

The piezoelectric element 47 is connected to an electronic control unit 10 (FIG. 4) via lead wires 70 and controlled on the basis of a signal output from the electronic control unit 10. The piezoelectric element 47 has a stacked construction obtained by stacking a plurality of piezoelectric thin plates. This piezoelectric element 47 is axially expanded when charged with electrons, and is axially contracted when the electrons are discharged therefrom. Both the fuel spill chamber 41 and the pressure chamber 48 are filled with fuel, and therefore, when the piezoelectric element 47 is charged with electrons, and thus is axially expanded, the pressure of fuel in the pressure chamber 48 is increased. If the pressure of fuel in the pressure chamber 48 is increased, the pressure pin 50 is moved upward, and accordingly, the spill control valve 46 is moved upward. As a result, the valve head 43 of the spill control valve 42 closes the valve port 44, and thus the spill of fuel from the fuel spill passage 40 into the fuel spill chamber 41 is stopped. Consequently, at this time, all of the fuel discharged into the pressurized fuel passage 33 (FIG. 2) from the pressure chambers 21 of the plungers 20 is fed into the reservoir chamber 4 (FIG. 4).

Conversely, when electrons are discharged from the piezoelectric element 47, and thus the piezoelectric element 47 is contracted, since the pressure piston 46 moves downward, the volume of the pressure chamber 48 is increased. As a result, since the pressure of fuel in the pressure chamber 48 is lowered, both the spill control valve 42 and the pressure pin 50 are moved downward by the spring force of the compression spring 53, and thus the valve head 43 of the spill fuel valve 42 opens the valve port 44. At this time, all of the fuel discharged into the pressurized fuel passage 33 (FIG. 2) from the pressure chambers 21 of the plungers 21 is spilled into the fuel spill chamber 41 via the fuel spill passage 40 and the valve port 44. Consequently, at this time, high pressure fuel is not fed into the reservoir chamber 4 (FIG. 4).

The fuel spilled into the fuel spill chamber 41 from the fuel spill passage 40 is returned to the fuel tank 7 (FIG. 4) via the fuel outflow bores 54, 55, 60 and the check valves 56, 61. At this time, the pressure of fuel in the fuel spill chamber 41 is maintained at a constant pressure which is higher that the atmospheric pressure, because the valve opening pressures of the check valves 56, 61 are higher than the atmospheric pressure. As mentioned above, when electrons are discharged from the piezoelectric element 47, the pressure of fuel in the pressure chamber 48 is lowered. At this time, if the pressure of fuel in the pressure chamber 48 falls below the valve opening pressure of the check valve 67, the check valve 67 opens and the fuel in the fuel spill chamber 41 is fed into the pressure chamber 48. In this case, if the spring force of the compression spring 69 is very weak, i.e., the valve opening pressure of the check valve 67 becomes approximately equal to zero, the pressure of fuel in the pressure chamber 48 becomes almost the same as that in the fuel spill chamber 41. Nevertheless, the pressure chamber 48 is filled with fuel under pressure, and if the fuel in the pressure chamber 48 leaks, and as a result an air space is created in the pressure chamber 48, when the piezoelectric element 47 is charged with electrons, the pressure of fuel in the pressure chamber 48 is not increased, and thus a problem arises in that it is impossible to move the spill control valve 42 upward, and consequently, the pressure chamber 48 must be continuously filled with fuel. To this end, the pressure of fuel in the fuel spill chamber 41 is maintained at a pressure higher than the atmospheric pressure, and the check valve 67, which allows only an inflow of fuel into the pressure chamber 48 from the fuel spill chamber 41, is provided.

Figure 5:
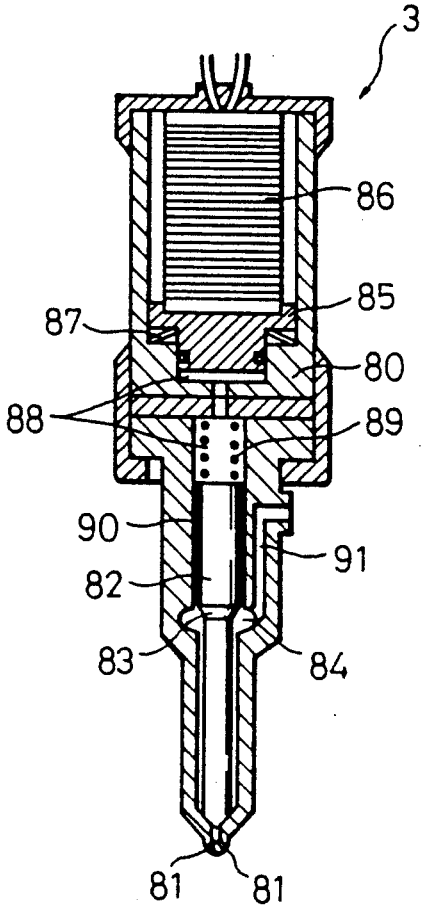
FIG. 5 is a cross-sectional side view of a fuel injector.

FIG. 5 illustrates an enlarged cross-sectional side view of the fuel injector 3 illustrated in FIG. 4.

Referring to FIG. 5, the fuel injector 3 comprises a needle 82 slidably inserted into the housing 80 thereof to control the opening of nozzle openings 81. a needle pressure chamber 84 formed around the conical shaped pressure receiving face 83 of the needle 82, a piston 85 slidably inserted into the housing 80, a piezoelectric element 86 inserted between the housing 80 and the piston 85, a flat spring 87 for biasing the piston 85 toward the piezoelectric element 86, a pressure control chamber 88 formed between the needle 82 and the piston 85, and a compression spring 89 for biasing the needle 82 toward the nozzle openings 81. The pressure control chamber 88 is connected to the needle pressure chamber 84 via a flow area restricted passage 90 formed around the needle 82, and the needle pressure chamber 84 is connected to the reservoir chamber 4 via a fuel passage 91 and the fuel distribution pipe 8 (FIG. 4). Consequently, high pressure fuel in the reservoir chamber 4 is introduced into the needle pressure chamber 84, and then a part of this high pressure fuel is introduced into the pressure control chamber 88 via the flow area restricted passage 90. Therefore, the pressures of fuel in the needle pressure chamber 84 and the pressure control chamber 88 become almost the same.

When electrons are discharged from the piezoelectric element 86, and thus the piezoelectric element 86 is contracted, since the piston 85 is moved upward, the pressure of fuel in the pressure control chamber 88 is abruptly lowered. As a result, the needle 82 is moved upward, and the injection of fuel from the nozzle openings 81 is started. Since the fuel in the needle pressure chamber 84 is introduced into the pressure control chamber 88 via the flow area restricted passage 90 during the time for which the injection of fuel is carried out, the pressure of fuel in the pressure control chamber 88 is gradually increased. Thereafter, when the piezoelectric element 86 is charged with electrons and thus is expanded, since the piston 85 is moved downward, the pressure of fuel in the pressure control chamber 88 is abruptly increased. As a result, the needle 82 is moved downward and closes the nozzle openings 81, and thus the injection of fuel is stopped. Since the fuel in the pressure control chamber 88 flows into the needle pressure chamber 84 via the flow area restricted passage 90 during the time for which the injection of fuel is stopped, the pressure of fuel in the pressure control chamber 88 is gradually lowered, and thereafter is returned to the original pressure.

Referring to FIG. 4, the electronic control unit 10 is constructed as a digital computer and comprises a ROM (read only memory) 101, a RAM (random access memory) 102, a CPU (microprocessor etc.) 103, an input port 104 and an output port 105. The ROM 101, the RAM 102, the CPU 103, the input port 104 and the output port 105 are interconnected via a bidirectional bus 100. The pressure sensor 9 produces an output voltage proportional to the pressure of fuel in the reservoir chamber 4, and this output voltage is input to the input port 104 via an analog-to-digital ("AD") converter 106. In addition, a crankangle sensor 107, which produces an output pulse each time the crankshaft (not shown) is rotated by 30 degrees, is connected to the input port 104, and the engine speed is calculated from the pulses output by the crankangle sensor 107. The output port 105 is connected to the piezoelectric element 47 of the actuator 45 via a drive circuit 108.

Figure 6:
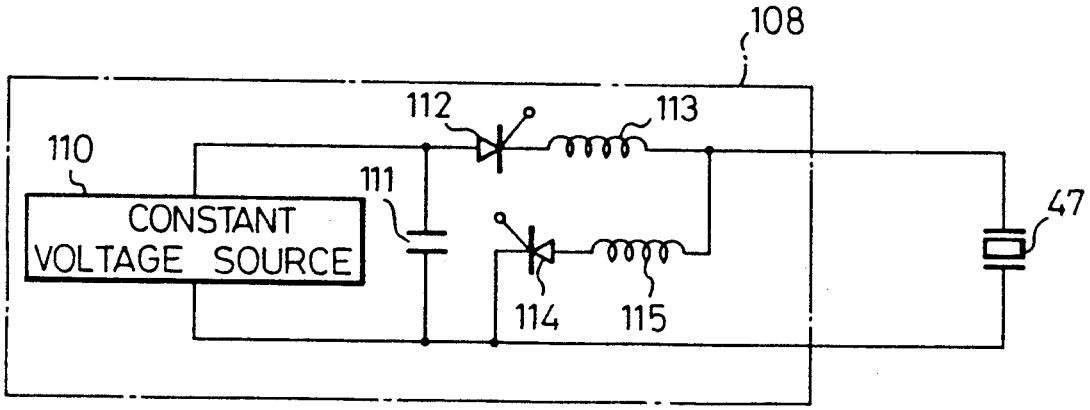
FIG. 6 is a circuit diagram of the drive circuit for the piezoelectric element.

FIG. 6 illustrates a circuit diagram of the drive circuit 108 for driving the piezoelectric element 47. Referring to FIG. 6, the drive circuit 108 comprises a constant voltage source 110, a condenser 111 charged by the constant voltage source 110, a thyristor 112 for the charge control, a coil 113 for the charge, a thyristor 114 for the discharge control, and a coil 115 for the discharge.

Figure 7:
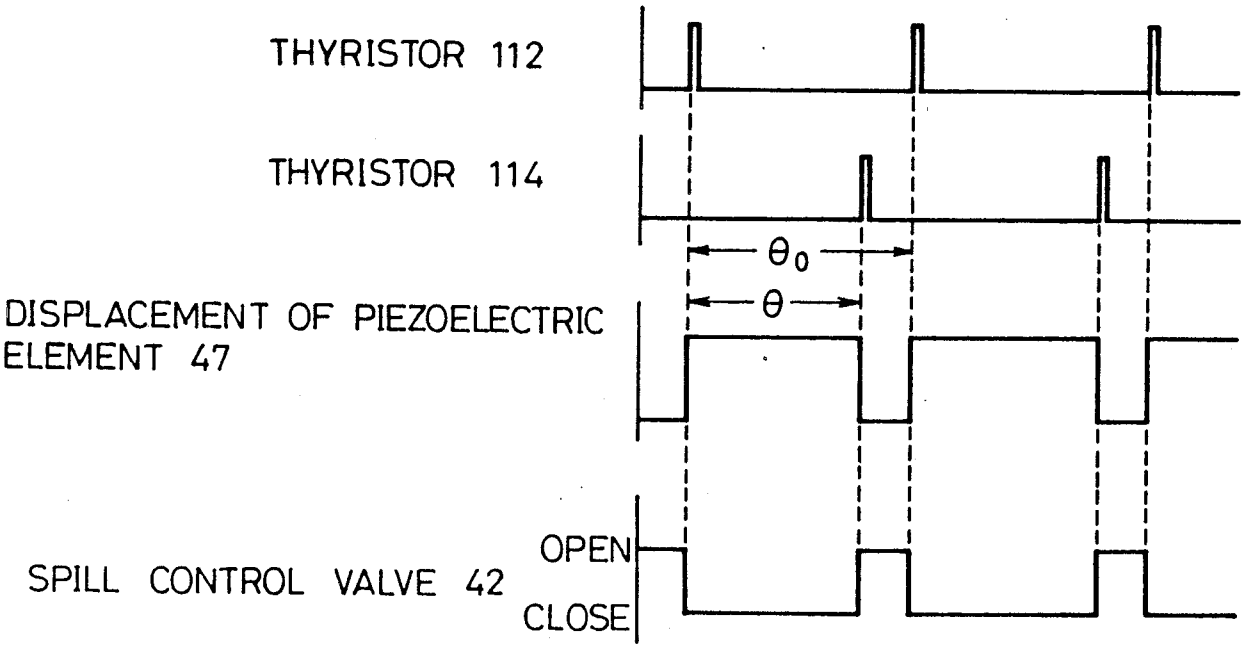
FIG. 7 is a time chart illustrating the operations of the piezoelectric element and the spill control valve.

When the thyristor 112 is made ON, as illustrated in FIG. 7, electrons charged in the condenser 111 are fed into the piezoelectric element 47 via the coil 113 for the charge, and thus the piezoelectric element 47 is charged with electrons. As a result, the piezoelectric element 47 is expanded and the spill control valve 42 is opened. Thereafter, when the thyristor 114 is made ON, the electrons are discharged from the piezoelectric element 47 via the coil 115 for the discharge. As a result, the piezoelectric element 47 is contracted and the spill control valve 42 is closed.

As mentioned above, when the spill control valve 42 is opened, all of the fuel under pressure discharged into the pressurized fuel passage 33 from the pressure chambers 21 of the plungers 20 is spilled via the spill control valve 42. Consequently, at this time, the fuel under pressure is not fed into the reservoir chamber 4. Conversely, when the spill control valve 42 is closed, all of the fuel under pressure discharged from the pressure chambers 21 of the plungers 20 is fed into the reservoir chamber 4, and as a result, the pressure of fuel in the reservoir chamber 4 is increased.

The amount of fuel injected by the fuel injectors 3 is fixed by the fuel injection time and the pressure of fuel in the reservoir chamber 4, and the pressure of fuel in the reservoir chamber 4 is normally maintained at a predetermined target pressure. In addition, a necessary amount of fuel is fed into each cylinder during each two complete revolutions of the crankshaft, and therefore, the amount of fuel in the reservoir chamber 4 is reduced each time the crankshaft is rotated by a fixed angle of rotation. Consequently, to maintain the pressure of fuel in the reservoir chamber 4 at a target pressure, preferably fuel under pressure is fed into the reservoir chamber 4 each time the crankshaft is rotated by a fixed angle of rotation of the crankshaft. Therefore, the spill control valve 42 is normally closed each time the crankshaft is rotated by a fixed angle of rotation of the crankshaft to feed fuel under pressure discharged from the pressure chambers 21 of the plungers 20 into the reservoir chamber 4, and the spill control valve 42 remains open until closed again. In this case, the amount of fuel under pressure fed into the reservoir chamber 4 is increased as the angle of rotation of the crankshaft during which the spill control valve 42 remains closed while the above-mentioned fixed angle of rotation of the crankshaft is increased. That is, as illustrated in FIG. 7, if an angle $\theta$ of the crankshaft rotation during which the spill control valve 47 remains closed for the fixed angle $\theta_0$ of the crankshaft rotation, i.e., an angle $\theta$ of the crankshaft rotation during which the piezoelectric element 47 is expanded for the fixed angle $\theta_0$ of the crankshaft rotation is called the duty ratio DT ($=\theta/\theta_0$), and the amount of fuel under pressure fed into the reservoir chamber 4 increased as the duty ratio DT becomes larger.

Figure 8A:
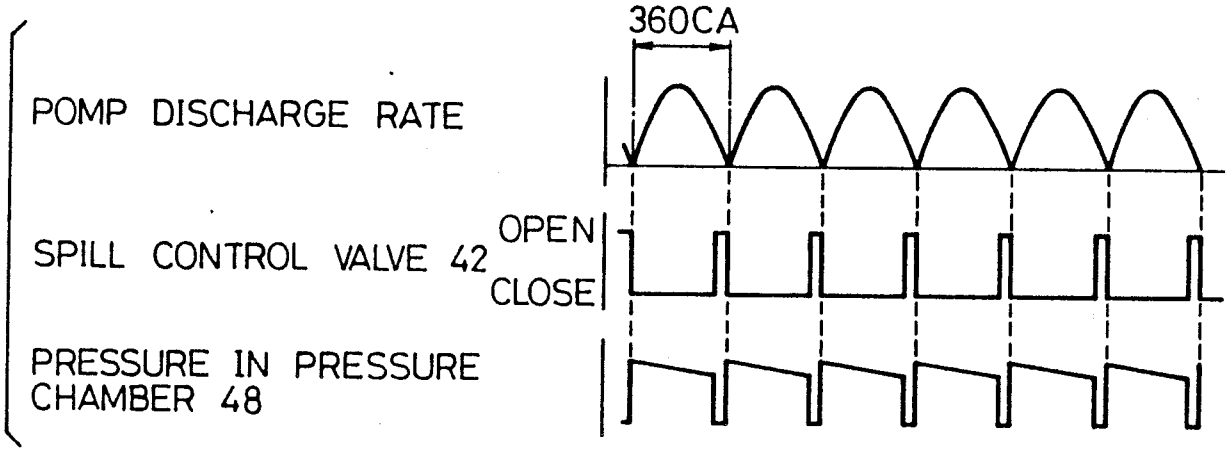
FIGS. 8(A) through (C) are time charts illustrating the operation of the spill control valve and a change in the pressure of fuel in the pressure chamber.
Figure 8B:
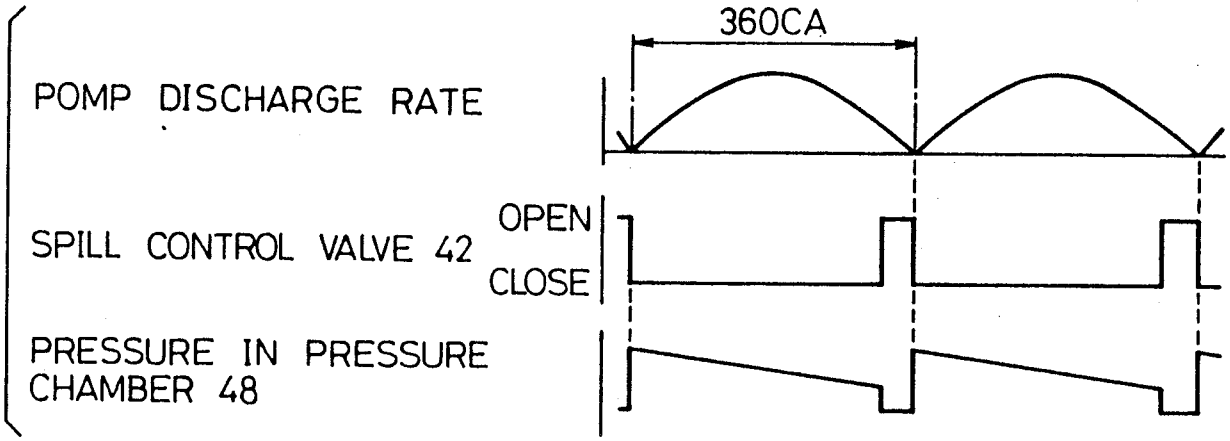
Figure 8C:
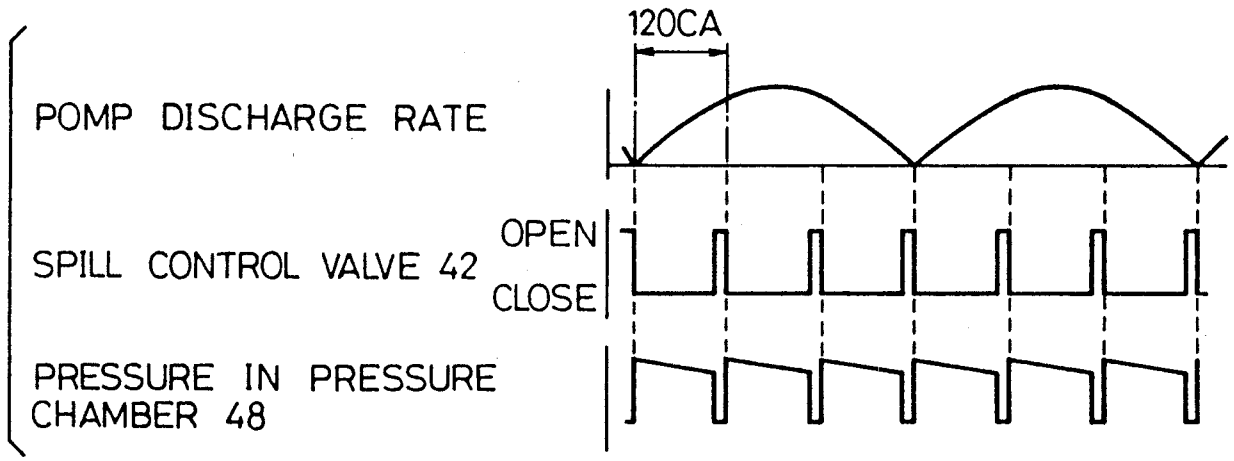

In the embodiment illustrated in FIG. 1, the fuel feed pump A is rotated at a speed which is one half of the engine speed, and thus the pump discharge rate (i.e., the rate at which fuel is discharged from the pressure chambers 21 of the plungers 20) is repeatedly changed at each 360 degrees (CA) of rotation of the crankshaft as illustrated in FIGS. 8(A) and (B). In this case, if the timing of the closing operation of the spill control valve 42 is fixed at the end of the discharge stroke of fuel feed pump A, the spill control valve 42 is closed each time the crankshaft is rotated by 360 degrees, as illustrated in FIGS. 8(A) and (B). In this case, where the pressure of fuel in the reservoir chamber 4 has been reduced to near the atmospheric pressure, as when the engine is started, or where the target pressure of fuel in the reservoir chamber 4 is increased, since a large amount of fuel under pressure must be fed into the reservoir chamber 4, the angle of rotation of the crankshaft during which the spill control valve 42 remains closed becomes larger. However, when the spill control valve 42 is closed, i.e., when the pressure of the fuel in the pressure chamber 48 is increased, the fuel in the pressure chamber 48 leaks through the clearances around the pressure piston 46 or the pressure pin 50, and thus the pressure of fuel in the pressure chamber 48 is gradually lowered. Nevertheless, even if the pressure of the fuel in the pressure chamber 48 is gradually lowered, when the engine is rotating at a relatively high speed as illustrated in FIG. 8(A), the time for which the spill control valve 42 remains closed is relatively short, and thus the pressure of fuel in the pressure chamber 48 is not greatly lowered. When, however, the engine speed becomes relatively low as illustrated in FIG. 8(B), since the time for which the spill control valve 42 remains closed becomes long, the pressure of the fuel in the pressure chamber 48 is greatly lowered, and thus a problem arises in that it is impossible to maintain the spill control valve 42 at the closed position. Thus, in the embodiment according to the present invention, when the engine speed becomes relatively low, the spill control valve 42 is controlled so that it is closed each time the crankshaft is rotated by, for example, 120 degrees, as illustrated in FIG. 8(C). If the angle of the crankshaft rotation at which the closing operation of the spill control valve 42 is carried out is made smaller, as mentioned above, the time for which the spill control valve 42 remains closed will not become excessively long. As a result, since the pressure of fuel in the pressure chamber 48 is not greatly lowered, it is possible to maintain the spill control valve 42 at the closed position.

Figure 9:
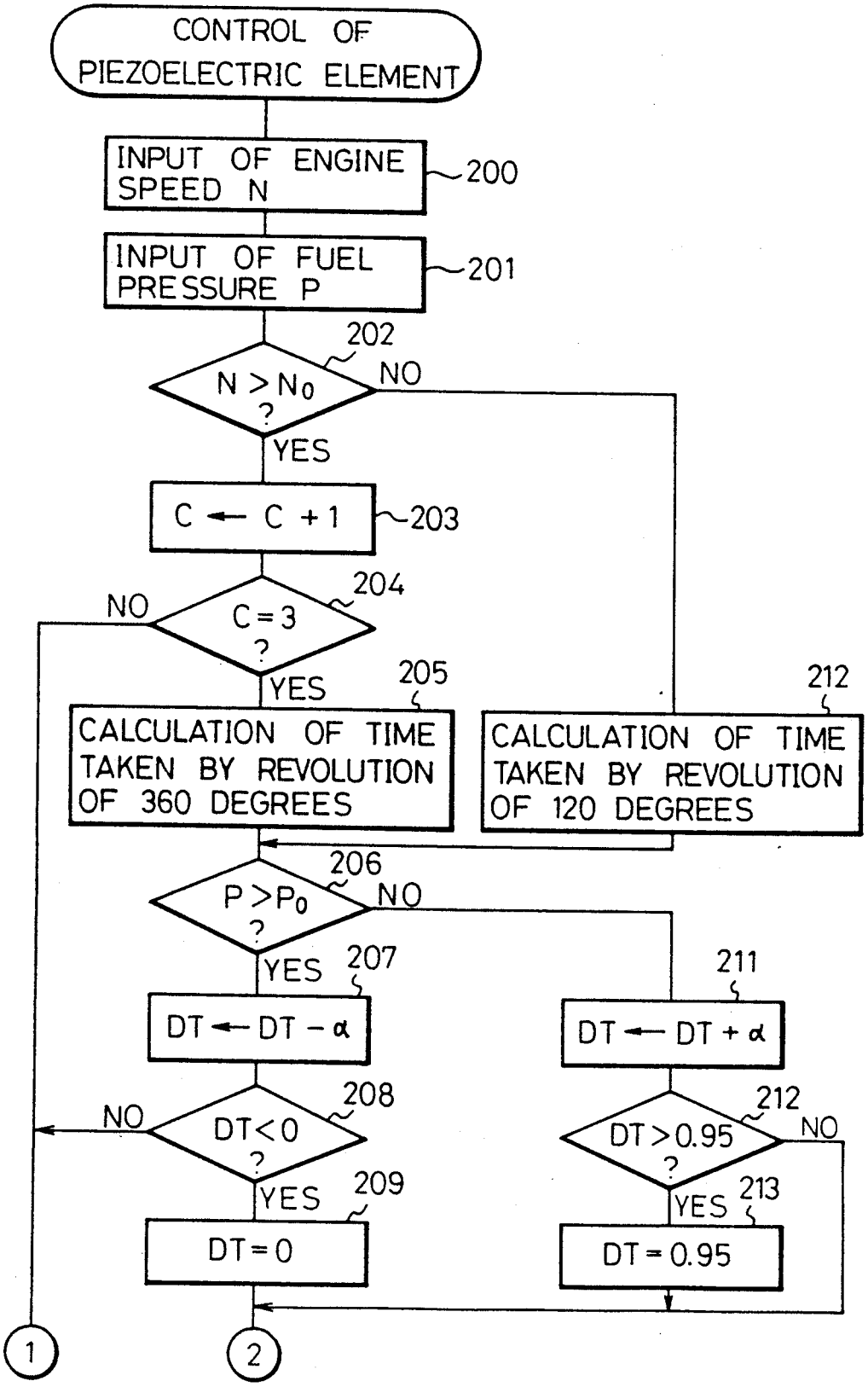
FIGS. 9 and 10 are a flow chart of the controlling of the piezoelectric element.
Figure 10:
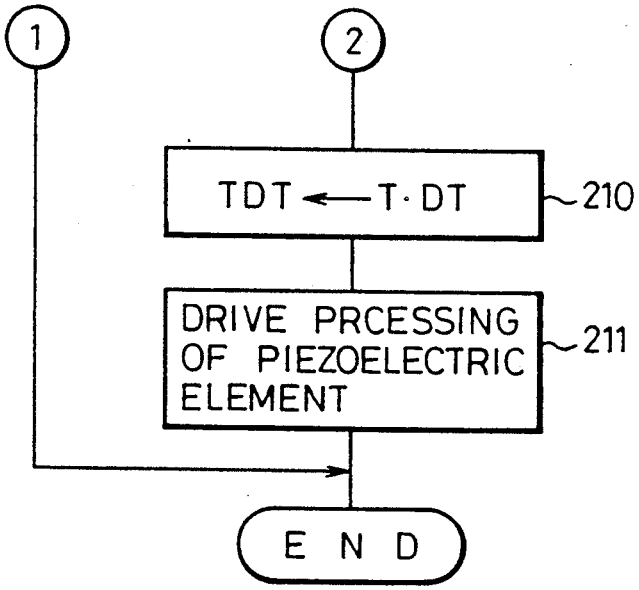

Next, the method of controlling the piezoelectric element 47 will be described with reference to FIGS. 9 and 10. FIGS. 9 and 10 illustrate a routine for controlling the piezoelectric element 47, and this routine is processed by sequential interruptions executed at each 120 degrees of rotation of the crankshaft.

Referring to FIGS. 9 and 10, in step 200, the engine speed N calculated from pulses output from the crankangle sensor 107 is input to the CPU 103, and then in step 201 the output signal of the pressure sensor 9, which represents the pressure P of fuel in the reservoir chamber 4, is input to the CPU 103. Then, in step 202, it is determined whether or not the engine speed N is higher than a predetermined fixed speed $N_0$. If N is greater than $N_0$, the count value C is incremented by one in step 203, and then the routine goes to step 204. In step 204, it is determined whether or not the count value C is equal to 3, and when the count value C becomes equal to 3, the routine goes to step 205. Consequently, the routine goes to step 205 at each 360 degrees of rotation of the crankshaft. In step 205, the time T taken by the crankshaft to rotate by 360 degrees is calculated from the engine speed N, and the routine goes to step 206. In step 206, it is determined whether or not the pressure of fuel P in the reservoir chamber 4 is higher than a target pressure $P_0$. If P is greater than $P_0$, the routine goes to step 207, and a predetermined fixed value $\alpha$ is subtracted from the duty ratio DT. Then, in step 208, it is determined whether or not the duty ratio DT is negative. If DT is less than 0, the routine goes to step 209 and the duty ratio DT is made zero. Then the routine goes to step 210. Conversely, if it is determined in step 206 that the pressure of fuel P is or equal to the target pressure $P_0$, the routine goes to step 211, and a predetermined fixed value $\alpha$ is added to the duty ratio DT. Then, in step 212, it is determined whether or not the duty ratio DT is larger than 0.95. If $DT>0.95$, the routine goes to step 213 and the duty ratio DT is made 0.95. Then the routine goes to step 210.

In step 210, the duty ratio TDT represented by time is calculated by multiplying the duty ratio DT by the time T calculated in step 205. Then, in step 211, the control data for the thyristors 112, 114 is output to the output port 105 so that the time during which the piezoelectric element 47 is expanded becomes equal to this duty ratio TDT. Consequently, if the pressure P of fuel in the reservoir chamber 4 exceeds the target pressure $P_0$, since the duty ratio TDT becomes low, the amount of fuel under pressure fed into the reservoir chamber 4 is reduced, and thus the pressure of fuel P in the reservoir chamber 4 is lowered. Conversely, if the pressure P of fuel in the reservoir chamber 4 becomes lower than the target pressure $P_0$, since the duty ratio TDT becomes high, the pressure P of fuel in the reservoir chamber 4 is increased. Thus, the pressure P of fuel is maintained at the target pressure $P_0$. In addition, if N is greater than $N_0$, i.e., when the engine speed N is relatively high, the duty ratio TDT is calculated at each 360 degrees of rotation of the crankshaft, and the spill control valve 42 is closed for the time determined by the duty ratio TDT at each 360 degrees of rotation of the crankshaft.

Conversely, if it is determined in step 202 that the engine speed N is lower than the fixed speed $N_0$, the routine goes to step 212. Consequently, the routine goes to step 212 at each 120 degrees of rotation of the crankshaft. In step 212, the time T taken by the crankshaft to rotate by 120 degrees is calculated from the engine speed N. Then, in steps 207 through 209, or in steps 211 through 213, the duty ratio DT is calculated. Then, in step 210, the duty ratio TDT represented by time is calculated by multiplying the duty ratio DT by the time T calculated in step 212. Consequently, if N is greater than $N_0$, i.e., when the engine speed N is relatively low, the duty ratio TDT is calculated at each 120 degrees of rotation of the crankshaft, and the spill control valve 42 is closed for the time determined by the duty ratio TDT at each 120 degrees of rotation of the crankshaft. Therefore, when the engine speed N is relatively low, the time for which the spill control valve 42 is closed, i.e., the time for which the pressure of fuel in the pressure chamber 48 becomes low, the pressure of fuel in the pressure chamber 48 is not lowered so much for the time the spill control valve 42 is closed. Therefore, it is possible to maintain the spill control valve 42 at the closed position.

In addition, electrons charged in the piezoelectric element 47 leak out little by little, and are discharged little by little. Therefore, the piezoelectric element 47 is gradually contracted as time elapses after the piezoelectric element 47 is charged with electrons, and as a result, the pressure of fuel in the pressure chamber 48 is gradually lowered. When, however, the engine speed N is relatively low, since the time for which the piezoelectric element 47 is charged with electrons becomes short, the piezoelectric element 47 contracts less. Therefore, also for this reason, it is possible to maintain the spill control valve 42 at the closed position.

In addition, when the engine is started, the charging and discharging operation of electrons for the piezoelectric element 47 must be repeated several times, for the piezoelectric element 47 to be charged with a sufficient amount of electrons and to be sufficiently expanded. When the engine speed N is relatively low, however, since the number of repetitions of the charging and discharging operations of electrons for the piezoelectric element 47 per a unit of time is increased, the piezoelectric element 47 can be charged with a sufficient amount of electrons immediately after the engine is started. In addition, since the number of repetitions of the charging and discharging operations of the electrons for the piezoelectric element 47 per a unit of time is increased, even if air bubbles exist in the fuel in the pressure chamber 48, it is possible to discharge these air bubbles from the pressure chamber 48.

In addition, if the spill control valve 47 is maintained at the closed position by maintaining the piezoelectric element 47 in a state in which it is charged with electrons, the pressure of fuel in the reservoir chamber 4 can be rapidly increased. But if the piezoelectric element 47 is maintained in a state in which it is charged with electrons, since the electrons are gradually discharged from the electronic element 47 as mentioned above, the piezoelectric element 47 is gradually contracted, and thus the pressure of fuel in the pressure chamber 48 gradually lowered. In addition, since the fuel in the pressure chamber 48 leaks, the pressure of fuel in the pressure chamber 48 is further lowered. To prevent the pressure of fuel in the pressure chamber 48 from dropping as mentioned above, it is necessary to periodically discharge electrons from the piezoelectric element 47. To this end, in steps 212 and 213 in FIG. 9, the maximum value of the duty ratio DT is made 0.95.

According to the present invention, it is possible to maintain the piezoelectric element at the closed position for a necessary time, regardless of the engine speed.

While the invention has been described by reference to a specific embodiment chosen for purposes of illustration, it should be apparent that numerous modifications could be made thereto by those skilled in the art without departing from the basic concept and scope of the invention.

I claim:

1. A device for controlling a fuel feed pump which discharges fuel under pressure into a pressurized fuel passage to feed the fuel into an engine via a fuel injector that initiates and terminates the discharge of fuel into the engine independently of the pressure of the fuel in the pressurized fuel passage, the fuel feed pump being driven by the engine and discharging the fuel under pressure at a rate which changes over a first fixed angle of the crankshaft of the engine, said device comprising:

a piezoelectric element;

a fuel spill passage branched from the pressurized fuel passage;

a pressure chamber filled with a working liquid having a pressure which is controlled by said piezoelectric element;

a spill control valve arranged in said fuel spill passage and controlled by the pressure of the working liquid in said pressure chamber;

detecting means for detecting an engine speed;

means for expanding said piezoelectric element each time the crankshaft of the engine rotates through a predetermined angle of rotation, to increase the pressure in said pressure chamber and maintain the pressure in said pressure chamber at an increased pressure to close said spill control valve; and control means for controlling said predetermined angle of rotation in accordance with a change in the engine speed to make said predetermined angle of rotation smaller as the engine speed becomes lower.

2. A device according to claim 1, wherein said control means changes said predetermined angle of rotation in accordance with whether the engine speed is higher than a predetermined fixed speed.

3. A device according to claim 2, wherein said predetermined angle of rotation becomes equal to a first fixed angle of rotation of the crankshaft when the engine speed is higher than said predetermined fixed speed and said predetermined angle of rotation becomes equal to a second fixed angle of rotation of the crankshaft, which is smaller than said first fixed angle of rotation, when the engine speed is lower than said predetermined fixed speed.

4. A device according to claim 3, wherein the fuel feed pump is driven by the engine and discharges the fuel under pressure in an amount which periodically changes at each 360 degrees of rotation of the crankangle, and said first fixed angle of rotation of the crankshaft is 360 degrees, and said second fixed angle of rotation of the crankshaft is 120 degrees.

5. A device according to claim 1, wherein pressure control means is provided for controlling a pressure of the fuel fed into the engine to maintain said pressure of the fuel at a predetermined pressure.

6. A device according to claim 5, wherein said pressure control means controls said pressure of the fuel by controlling a ratio of an angle of rotation of the crankshaft during which said piezoelectric element is expanded to said predetermined angle of rotation of the crankshaft.

7. A device according to claim 6, wherein pressure detecting means is provided for detecting said pressure of the fuel, and said pressure control means controls said ratio to equalize said pressure of the fuel with said predetermined pressure.

8. A device according to claim 6, wherein said pressure control means controls said ratio to prevent said ratio from increasing beyond a predetermined maximum ratio.

9. A device according to claim 1, wherein said working liquid is a part of the fuel discharged from the fuel feed pump.

10. A device according to claim 9, wherein said fuel spill passage is connected to a fuel spill chamber via said spill control valve, and said fuel spill chamber is connected to said pressure chamber via a check valve which allows only an inflow of fuel into said pressure chamber from said fuel spill chamber.

11. A device according to claim 10, wherein fuel in said fuel spill chamber is discharged via a check valve which has a valve opening pressure higher than that of said check valve arranged between said fuel spill chamber and said pressure chamber.

12. A device according to claim 1, wherein said pressure of the working liquid is transferred to said spill control valve via a pressure pin which has one end abutting against said spill control valve and the other end exposed to said pressure chamber.

13. A device according to claim 12, wherein said fuel spill passage is connected to a fuel spill chamber via said spill control valve, and fuel having a pressure which is the same as that of fuel in said fuel spill chamber is introduced to one end of said spill control valve, which is positioned in the opposite direction of said pressure pin.

14. A device according to claim 1, wherein the fuel feed pump is driven by the engine at a speed which is one half of the engine speed, and the fuel feed pump comprises a pair of plungers which move in opposite directions to continuously discharge fuel under pressure.

15. A device according to claim 14, wherein said means for expanding said piezoelectric element expands said piezoelectric element at the end of a discharge stroke of the fuel feed pump when the engine speed is higher than a predetermined speed.

16. A device for controlling a fuel feed pump which discharges fuel under pressure into a pressurized fuel passage to feed the fuel into an engine, via a fuel injector that initiates and terminates the discharge of fuel into the engine independently of the pressure of the fuel in the pressurized fuel passage, the fuel feed pump being driven by the engine and discharging the fuel under pressure at a rate which changes over a first fixed angle of the crankshaft of the engine, said device comprising:

a piezoelectric element;

a fuel spill passage branched from the pressurized fuel passage;

a pressure chamber filled with a working liquid having a pressure which is controlled by said piezoelectric element;

a spill control valve arranged in said fuel spill passage and controlled by the pressure of the working liquid in said pressure chamber;

detecting means for detecting an engine speed;

a drive circuit expanding said piezoelectric element each time the crankshaft of the engine rotates through a predetermined angle of rotation, to increase the pressure in said pressure chamber and maintain the pressure in said pressure chamber at an increased pressure to close said spill control valve; and a control circuit controlling said predetermined angle of rotation in accordance with a change in the engine speed to make said predetermined angle of rotation smaller as the engine speed becomes lower.

* * * * *

UNITED STATES PATENT AND TRADEMARK OFFICE

CERTIFICATE OF CORRECTION

PATENT NO. : 5,070,848

DATED : December 10, 1991

INVENTOR(S) : Mitsuyasu

It is certified that error appears in the above-identified patent and that said Letters Patent is hereby corrected as shown below:

Column 3, line 6, change "pressure" to - high pressure -.

line 29, change "23" to - 22 -.

line 29, change "22" to - 23 -.

Column 7, line 65, change "increased" to - increases -.

Column 9, line 13, change "---is or ---" to - ---is lower than or --- -.

line 30, change "pressure of fuel P" to - pressure P of fuel -.

line 53,54, change "greater than" to - less than or equal to -.

Column 10, line 64, after "angle" insert --of rotation--.

Column 11, line 24, change "a" to - said -.

line 29, change "---rotation, when ----" to - -----rotation and less than or equal to one half of said first fixed angle of rotation, when ---- -.

line 32-36, delete "the--------and".

Column 12, line 21-23, change "the --------speed" to - said first fixed angle of rotation is 360 degrees.

UNITED STATES PATENT AND TRADEMARK OFFICE

CERTIFICATE OF CORRECTION

PATENT NO. : 5,070,848

DATED : December 10, 1991

INVENTOR(S) : Mitsuyasu

It is certified that error appears in the above-indentified patent and that said Letters Patent is hereby corrected as shown below:

Column 12, line 23, change "---, and ---" to - ---said first fixed angle of rotation is 360 degrees, and ---- -.

Signed and Sealed this

Tenth Day of May, 1994

Bruce Lehman

*Attest:*

BRUCE LEHMAN

*Attesting Officer*

*Commissioner of Patents and Trademarks*